US006370501B1

(12) United States Patent
Chen et al.

(10) Patent No.: US 6,370,501 B1
(45) Date of Patent: Apr. 9, 2002

(54) METHOD OF DEGROUPING A CODEWORD IN MPEG-II AUDIO DECODING BY ITERATIVE ADDITION AND SUBTRACTION

(75) Inventors: Liang-Gee Chen; Tsung-Han Tsai; Ren-Jr Wu, all of Taipei (TW)

(73) Assignee: National Science Council, Taipei (TW)

( * ) Notice: Subject to any disclaimer, the term of this patent is extended or adjusted under 35 U.S.C. 154(b) by 0 days.

(21) Appl. No.: 09/296,878

(22) Filed: Apr. 22, 1999

(30) Foreign Application Priority Data

Apr. 30, 1998 (TW) ..... 87106736 A

(51) Int. Cl.[7] ..... G10L 19/00
(52) U.S. Cl. ..... 704/229; 704/500
(58) Field of Search ..... 704/229, 500

(56) References Cited

U.S. PATENT DOCUMENTS 5,806,026 A * 9/1998 Kim ..... 704/229

OTHER PUBLICATIONS

Tsai, Tsung–Han, Liang–Gee Chen, Yuan–Chen Liu, Yeong–Kang Lai, and Po–Cheng Wu, "A Novel MPEG–2 Audio Decoder with Efficient Data Arrangement and Memory Configuration," Int. Conf. Consumer Electron. 1997 Digest of Technical Papers ICCE, pp. 212–213, 11–13 Jun. 1997.*

Tsai, Tsung–Han, Liang–Gee Chen, Hao–Chieh Chang, and Sheng–Chieh Huang, "A Modified MPEG–2 Audio Decoding Scheme based on its Low–Cost Fast Algorithm and Efficient Data Scheduling," Proc. 1998 IEEE Int. Symp. Circuits and Systems ISCAS 98, vol. 5, pp. 530–533, May 31–Jun. 3, 1998.*

Tsai, Tsung–Han, Liang–Gee Chen, and Ren–Jr Wu, "A Cost–Effective Design for MPEG2 Audio Decoder with Embedded RISC Core," 1999 IEEE Workshop on Signal Processing Systems SIPS 99, pp. 361–369, Oct. 20–22, 1999.*

* cited by examiner

*Primary Examiner*—William Korzuch
*Assistant Examiner*—Donald L. Storm
(74) *Attorney, Agent, or Firm*—Bacon & Thomas

(57) ABSTRACT

The invention describes a simple and efficient codeword degrouping algorithm which can be applied in an MPEG audio decoder, in which a codeword is degrouped into three samples. According to the proposed algorithm, the division and modulo computations applied in the original degrouping method can be fully substituted into the addition and subtraction computations by using the mode selection and iterative decompositions, and thus largely reduces the overhead and complexity for the decoder. Also, an efficient architecture for the proposed algorithm includes one special adder, two subtractors, and two adders. The architecture generates the quotient and remainder simultaneously with fix-rate throughput.

8 Claims, 10 Drawing Sheets

METHOD OF DEGROUPING A CODEWORD IN MPEG-II AUDIO DECODING BY ITERATIVE ADDITION AND SUBTRACTION

FIELD OF THE INVENTION

The present invention is related to an algorithm and architecture for degrouping a codeword in MPEG-II audio decoding, and in particular to an algorithm and architecture for degrouping a codeword in MPEG-II audio decoding which rely on just only using the addition and subtraction instead of the traditional division and modulo arithmetic operations without loss of accuracy.

BACKGROUND OF THE INVENTION

The MPEG audio coding standard is the international standard for the compression of digital audio signals. It can be applied both for audiovisual and audio-only applications to significantly reduce the requirements of transmission bandwidth and data storage with low distortion. The second phase of MPEG, labeled as MPEG-II, aims to support all the normative feature listed in MPEG-I audio and provide extension capabilities of multi-channel and multilingual audio and on an extension of standard to lower sampling frequencies and lower bit rates. No matter what is MPEG-I or MPEG-II standard, the MPEG audio compression standard defines threes layers of compression, named as Layer I, II, and III. Each successive layer offers better compression performance, but at a higher complexity and computation cost. Layer I and II are basically similar and based on subband coding. The difference between them mainly lies in formatting side information and a finer quantization is provided in Layer II. Layer III adopts more complex schemes such as hybrid filterbank, Huffman coding and non-linear quantization. From the viewpoint of hardware complexity and achieved quality, Layer II might be a reasonable compromise for general usage. In the official ISO/MPEG subject tests, Layer II coding shows an excellent performance of CD quality at a 128 Kbps per monophonic channel.

Within the Layer II decoding, degrouping is the key component which can recover the samples from a more compressed codeword. As will be described in more detail below, the arithmetic operations for degrouping mainly contain division and modulo. As the conventional methods, there have been executed the arithmetic operations by a general purpose DSP or ASP (audio signal processor) which have some division or modulo instructions. These designs basically implied either a divider directly, or a multiplier by finding the inverse of the divisor and multiplying the inverse by the dividend. These approaches increased the hardware complexity of the processor and the chip area. Several techniques used a ROM-based table lookup to replace the multiplier. Nevertheless, ROM circuit grows exponentially with the dimension of the finite field. Although many fast algorithms for computing the division and modulo arithmetic operations have been presented throughout the years, these techniques cannot be fully adopted in the MPEG degrouping algorithm. So far no dedicated degrouping algorithm and architecture is known.

The overall MPEG decoding flow chart is described in FIG. 1. FIG. 2 shows a further decomposition of inverse quantization of samples in Layer II application. In MPEG audio encoder, given the number of steps from bit allocation, the samples will be quantized. If grouping is required, three consecutive samples are coded as one codeword. For 3-, 5-, and 9-level quantization, a triplet is coded using a 5-, 7-, or 10-bit codeword, respectively. Only one value Vj is transmitted for this triplet. The relations between the coded value Vj and the three consecutive subband samples x, y, z are listed in Table 1.

TABLE 1

The relations between the codeword and the three consecutive samples

| Equation | Quantization level | Range of V | Number of bits of V | Mode |
|---|---|---|---|---|
| $V_a = 9z + 3y + x$ | 3 | 0 . . . 26 | 5 | 1 |
| $V_b = 25z + 5y + x$ | 5 | 0 . . . 124 | 7 | 2 |
| $V_c = 81z + 9y + x$ | 9 | 0 . . . 728 | 10 | 3 |

If the grouping is used in encoder, it is necessary to separate the combined sample codeword to the individual samples by degrouping in decoder. According to the grouping equations in Table 1, the degrouping have to perform the division and modulo operations to separate the three individual samples. This process is supplied by MPEG standard algorithm and depicted as follows:

| Algorithm | Degrouping |
|---|---|
| | for(i = 0;i < 3;i++)<br>{<br>s[i] = c%nlevels;<br>c = (int)c/nlevels;<br>} |

wherein s[i] the reconstructed sample

| | |
|---|---|
| c | the codeword |
| nlevels | the number of quantization level. |

Within the degrouping algorithm, the nlevels can be 3, 5, and 9 as shown in Table 1.

Table 2 summarizes the total arithmetic operations in MPEG Layer II audio decoding. A similar analysis of the arithmetic operations in decoding algorithm shows that multiplication and addition are the most common operations which mainly focus on synthesis subband filter. Especially in MPEG-II decoding, degrouping only occupies about 1% computation power of the whole decoding process. More specifically, these arithmetic operations are fully different and generally can't be shared with other resource of decoding functions. Thus, a low cost and high performance degrouping algorithm and architecture are necessary to reduce the circuit overhead and complexity.

TABLE 2

Arithmetic operations in MPEG Layer II audio decoding

| Classification | Function | Operations |
|---|---|---|
| IQ | Degrouping | $y = c \% a, c = c/d$ |
| | Requatization | $y = (x + a)b$ |
| | Rescalization | $y = ax$ |
| Syn. Subband | IMDCT | $y = ax + b, y = \Sigma_i C_i x_i$ |
| | IPQMF | $y = ax, y = \Sigma_i w_I$ |

SUMMARY OF THE INVENTION

A primary objective of the present invention is to provide an efficient algorithm for degrouping a codeword in MPEG-II audio decoding, in which the arithmetic operations involved are only addition and subtraction instead of the division and modulo used in the conventional algorithm.

Another objective of the present invention is to provide an architecture for degrouping a codeword in MPEG-II audio decoding, which not only have a simple and low cost design, but can generate a fixed throughput, i.e. one sample is decoded per clock number independent from the value of the input codeword.

DETAILED DESCRIPTION OF THE INVENTION

Figure 1:
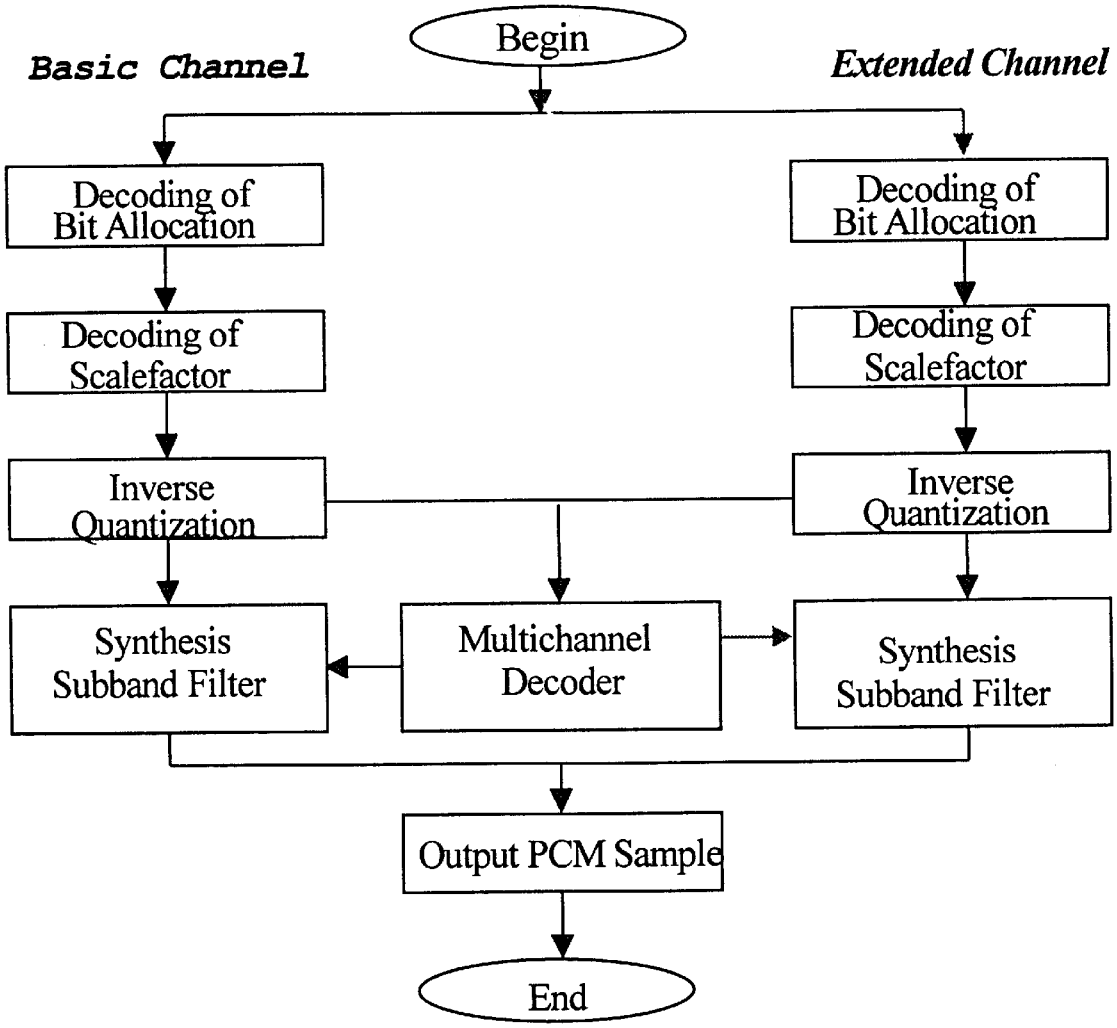
FIG. 1 shows a MPEG decoding flow chart.
Figure 2:
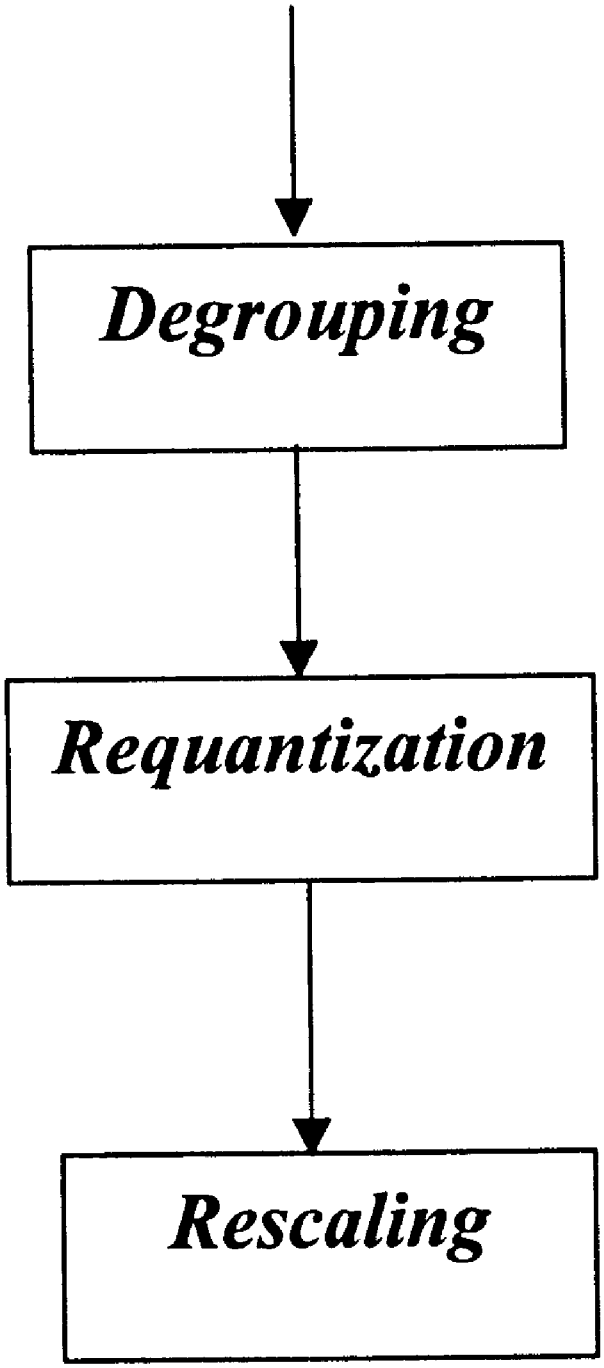
FIG. 2 shows a flow chart of the inverse quantization in FIG. 1 MPEG decoding.

In the present invention, we propose a novel MPEG degrouping process algorithm and its architecture design. They will be built by using quite different design concept than all the prior art works. Our approach relies on just only using the addition and subtraction instead of the traditional division and modulo arithmetic operations without loss of accuracy. Not any multiplier, divider and ROM table are needed in our design. It is further objective of the proposed design to provide the circuit which avoids the need for iterative division techniques involving multiple clocked registers, the clocked registers being used only to store initial input. The design takes the advantages of simple and low cost, but high efficient requirement with fixed throughput.

Proposed Algorithm

Let A, m are any two positive integers and A, m>0. Then we can express:

$$A=m\cdot q+r$$

wherein q is the quotient, and r is the remainder.

Besides, A can be represented as an n-digit tuple:

$$\begin{aligned} A &= \sum_{i=0}^{n-1} a_i\cdot 2^i \\ &= a_0 + a_1\cdot 2 + a_2\cdot 2^2 + \ldots + a_{n-1}\cdot 2^{n-1} \\ &= (a_{n-1}, a_{n-2}, a_{n-3}, \ldots, a_1, a_0) \end{aligned} \tag{2}$$

whrein $a_0, a_1 \ldots a_{n-1} \in [0, 1]$, $n = \lceil \log_2(A+1) \rceil$.

Case 1: $m=2^p$

From (1) and (2), A can be represented as given below when $m=2^p$:

$$\begin{aligned} A &= 2^p\cdot q + r \\ &= \sum_{i=0}^{p-1} a_i\cdot 2^i + 2^p\cdot[a_p + a_{p+1}\cdot 2 + a_{p+2}\cdot 2^2 + \ldots + a_{n-1}\cdot 2^{n-1}] \end{aligned} \tag{3}$$

Comparing between (1) and (3), thus q and r can be expressed:

$$\begin{aligned} q &= a_p + a_{p+1}\cdot 2 + a_{p+2}\cdot 2^2 + \ldots + a_{n-1}\cdot 2^{n-1} \\ &= (a_{n-1}, a_{n-2}, a_{n-3}, \ldots, a_{p+1}, a_p) \end{aligned} \tag{4}$$

$$\begin{aligned} r &= \sum_{i=0}^{p-1} a_i\cdot 2^i \\ &= (a_{p-1}, a_{p-2}, a_{p-3}, \ldots, a_1, a_0) \end{aligned} \tag{5}$$

Case 2: $m=2^p+1$:

From (1), A can be represented as given below when $m=2^p+1$:

$$\begin{aligned} A &= (2^p+1)\cdot q + r \\ &= 3\cdot q + r, \qquad p=1 \\ &= 5\cdot q + r, \qquad p=2 \\ &= 9\cdot q + r, \qquad p=3 \end{aligned} \tag{6}$$

wherein p=1, 2, and 3 are mapping to the three modes for degrouping algorithm, respectively.

The equation (6) can be rewritten according to equation (3) as follows:

$$\begin{aligned} A &= (2^p+1)\cdot q + r \\ &= 2^p\cdot q_1 + r_1 \\ &= ((2^p+1)\cdot q_1 - q_1 + r_1) \end{aligned}$$

Again $q_1$ can be expressed as:

$$\begin{aligned} q_1 &= 2^p\cdot q_2 + r_2 \\ &= (2^p+1)\cdot q_2 - q_2 + r_2 \end{aligned}$$

Similarly, $q_2$ and so on can be expressed as:

$$\begin{aligned} q_2 &= 2^p\cdot q_3 + r_3 \\ &= (2^p+1)\cdot q_3 - q_3 + r_3 \\ &\vdots \\ q_{k-1} &= 2^p\cdot q_k + r_k \\ &= (2^p+1)\cdot q_k - q_k + r_k \\ q_k &= 2^p\cdot q_{k+1} + r_{k+1} \\ &= (2^p+1)\cdot q_{k+1} - q_{k+1} + r_{k+1} \end{aligned} \tag{7}$$

Because $q_k<2^p$, $q_{k+1}=0$, thus:

$$q_k=r_{k+1} \tag{8}$$

From the iterative decomposition of (7) and using (8), we can proceed as follows:

$$\begin{aligned} A &= (2^p+1)\cdot q_1 - q_1 + r_1 \\ &= (2^p+1)\cdot q_1 - \{((2^p+1)\cdot q_2 - q_2 + r_2)] + r_1 \\ &= (2^p+1)\cdot(q_1-q_2) + q_2 + r_1 - r_2 \\ &= (2^p+1)\cdot(q_1-q_2) + [((2^p+1)\cdot q_3 - q_3 + r_3)] + r_1 - r_2 \\ &= (2^p+1)\cdot(q_1-q_2+q_3) + (r_1-r_2+r_3-q_3) \\ &\vdots \\ &= (2^p+1)\cdot[q_1-q_2+q_3-\ldots+(-1)^{k+1}\cdot q_k] + \\ &\quad [r_1-r_2+r_3-\ldots+(-1)^{k+2}\cdot r_{k+1}] \end{aligned} \tag{9}$$

Comparing between (1) and (9), let $$q'=q_1-q_2+q_3 \ldots +(-1)^{k+1}\cdot q_k,$$

and $$r'=r_1-r_2+r_3 \ldots +(-1)^{k+2}\cdot r_{k+1}, \tag{10}$$

From (10), because $0 \leqq r_j \leqq 2^p-1$, for j=1,2,3 . . . k+1, the range of q' and r' can be expressed as follows:

$$-\left[(2^{n-k\cdot p}-1)+\left(\left\lceil\frac{k+1}{2}\right\rceil-1\right)\cdot(2^p-1)\right] \le r' \le \left\lceil\frac{k+1}{2}\right\rceil\cdot(2^p-1) \tag{11}$$

Substituting (11) into (9), we can obtain the range of q' as follows:

$$q-\left\lceil\frac{(2^{n-k\cdot p}-1)+\left(\left\lceil\frac{k+1}{2}\right\rceil-1\right)\cdot(2^p-1)}{2^p}\right\rceil \le q' \le q+\left\lfloor\frac{\left\lceil\frac{k+1}{2}\right\rceil\cdot(2^p-1)}{2^p}\right\rfloor \tag{12}$$

Arithmetic operations for mode 1, 2 and 3:

Mode 1 (p=1):

As shown in Table 1, A is 5. Comparing between (4) and (7), we can obtain k=4. From (4), (5) and (10), q' and r' can be expressed as follows:

$$\begin{aligned} q' &= q_1 - q_2 + q_3 - q_4 \\ &= (a_4, a_3, a_2, a_1) - (a_4, a_3, a_2) + (a_4, a_3) - (a_4), \text{ and} \\ r' &= r_1 - r_2 + r_3 - r_4 + r_5 \\ &= a_0 - a_1 + a_2 - a_3 + a_4, \end{aligned}$$

Further, q' and r' can be calculated from (11) and (12) after knowing p, k and n. The results are shown as follows:

$$-2 \leqq r' \leqq 3 \tag{13}$$

$$q-1 \leqq q' \leqq q+1 \tag{14}$$

Mode 2 (p=2):

As shown in Table 1, A is 7. Comparing between (4) and (7), we can obtain k=3. From (4), (5) and (10), q' and r' can be expressed as follows:

$$\begin{aligned} q' &= q_1 - q_2 + q_3 \\ &= (a_6, a_5, a_4, a_3, a_2) - (a_6, a_5, a_4) + (a_6), \text{ and} \\ r' &= r_1 - r_2 + r_3 - r_4 \\ &= (a_1, a_0) - (a_3, a_2) + (a_5, a_4) - a_6, \end{aligned}$$

Further, q' and r' can be calculated from (11) and (12) after knowing p, k and n. The results are shown as follows:

$$-4 \leqq r' \leqq 6 \tag{15}$$

$$q-1 \leqq q' \leqq q+1 \tag{16}$$

Mode 3 (p=3):

As shown in Table 1, A is 10. Comparing between (4) and (7), we can obtain k=3. From (4), (5) and (10), q' and r' can be expressed as follows:

$$\begin{aligned} q' &= q_1 - q_2 + q_3 \\ &= (a_9, a_8, a_7, a_6, a_5, a_4, a_3) - (a_9, a_8, a_7, a_6) + (a_9), \text{ and} \\ r' &= r_1 - r_2 + r_3 - r_4 \\ &= (a_2, a_1, a_0) - (a_5, a_4, a_3) + (a_8, a_7, a_6) - a_9, \end{aligned}$$

Further, q' and r' can be calculated from (11) and (12) after knowing p, k and n. The results are shown as follows:

$$-8 \leqq r' \leqq 14 \tag{17}$$

$$q-1 \leqq q' \leqq q+1 \tag{18}$$

Figure 3:
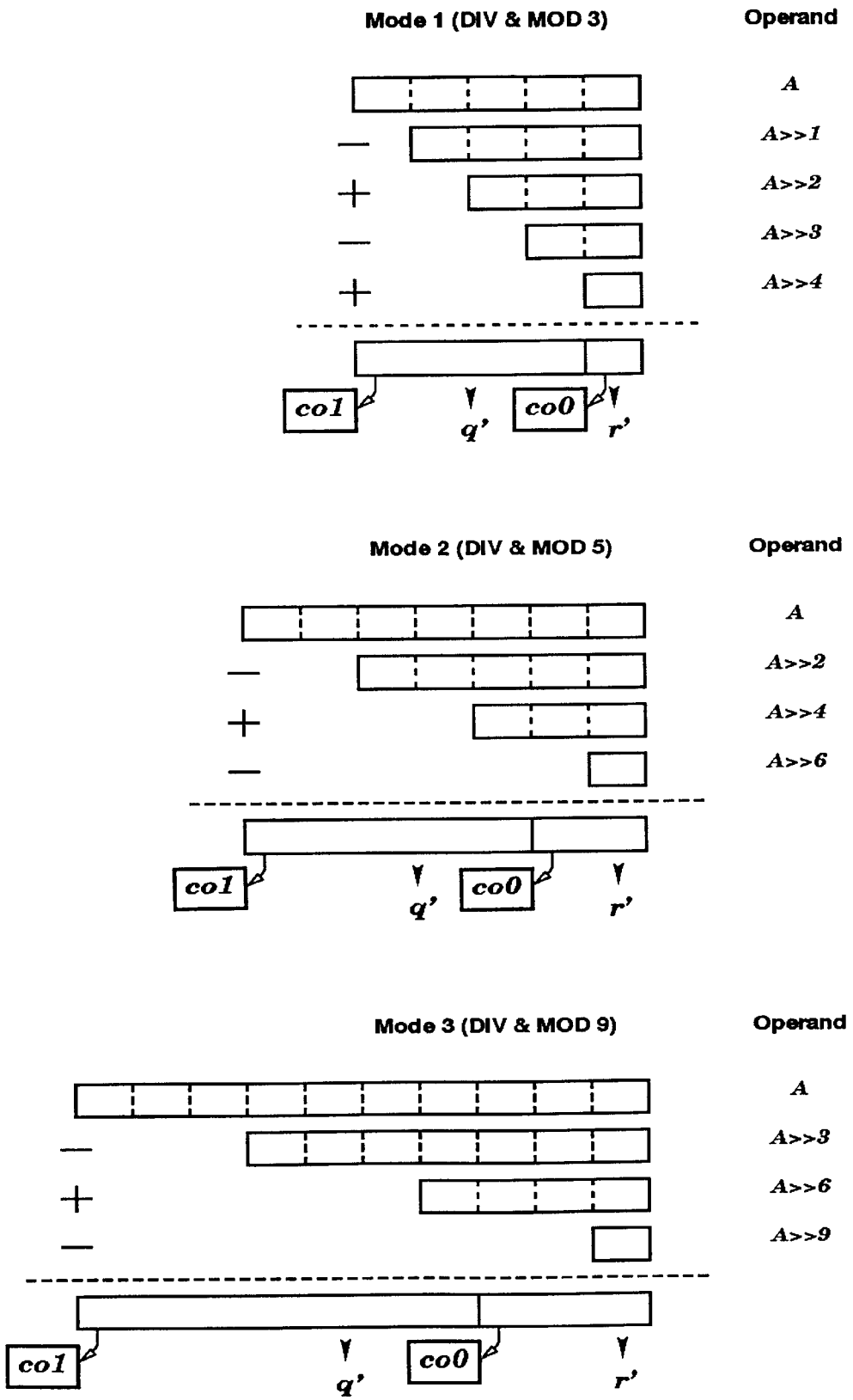
FIG. 3 is a graphical representation of proposed algorithm for the fast calculations of q' and r' in all three modes.

Based on the arithmetic operations discussed in the above three modes, the algorithm proposed in the present invention accomplishes the division and modulo by only processing the codeword A, which can be viewed as a 2-tuple representation of $q_k$ and $r_k$. Each intermediate operand, denoted as A>>p for convenience, is obtained by shifting right p bits and dropping rightmost p bits of A after each shift. FIG. 3 describes a graphical representation of the proposed algorithm for the fast calculating of q' and r' in the three modes. In Mode 1 (k=4), five operands A, A>>1, A>>2, A>>3, and A>>4 are generated by shifting right 1 bit. These operands take interlace computations of two subtractions and two additions to obtain a sum S. We can then obtain r' and q' from S as r'=LSB+(1,0)·co0, and q'=MSB−(co0), wherein LSB is the value of the lowest one bit of S, MSB is the value of the upper four bits of S, and co0 is the one-bit carry of addition for one-bit LSB of S.

In Mode 2 (k=3), four operands A, A>>2, A>>4, and A>>6 are generated by shifting right 2 bits. These operands take the interlace computations of two subtractions and one addition to obtain a sum S. We can then obtain r' and q' from S as r'=LSB+(1,0,0)·co0, and q'=MSB−(co0), wherein LSB is the value of the lowest two bit of S, MSB is the value of the upper five bits of S, and co0 is the one-bit carry of addition for two-bit LSB of S.

In Mode 3 (k=3), four operands A, A>>3, A>>6, and A>>9 are generated by shifting right 3 bits. These operands take the interlace computations of two subtractions and one addition to obtain a sum S. We can then obtain r' and q' from S as r'=LSB+(1,0,0,0)·co0, and q'=MSB−(co0), wherein LSB is the value of the lowest three bits of S, MSB is the value of the upper seven bits of S, and co0 is the one-bit carry of addition for the three-bit LSB of S.

Figure 4:
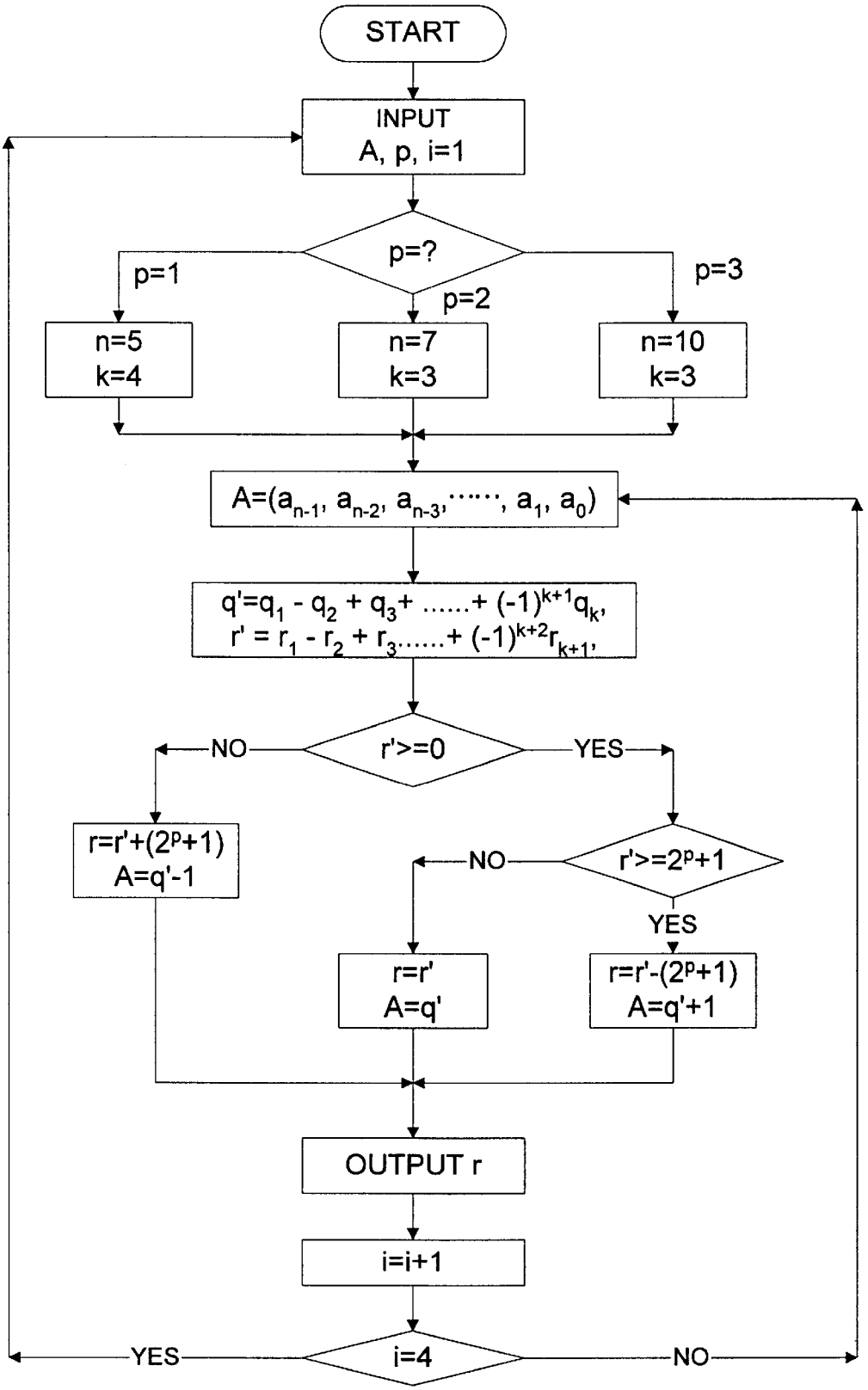
FIG. 4 shows an overall flow chart for the proposed algorithm shown in FIG. 3.

In addition to the fast calculation, the exactly correct results of q and r must need future process form q' and r' according to (13) to (18). The correct result of r is obtained by getting the r' plus or minus with a value of a divisor in each associated mode. The correct result of q is obtained by getting the q' plus or minus with a value of one in all three modes. This implies just a little and regular correction have to be performed to get the exactly right value of q and r from q' and r' respectively. The detailed flow chart of the proposed algorithm for the arithmetic operations in the above three modes shown in FIG. 3 is depicted in FIG. 4.

A method of degrouping a codeword according to the flow chart shown in FIG. 4 will be described hereinafter. A codeword to be degrouped has n bits and is grouped by:

$$A=(2^p+1)^2z+(2^p+1)y+x$$

wherein A is the codeword; x, y and z are three consecutive samples; and p is 1, 2 or 3, provided that n=5 and k=4, when p=1; n=7, k=3, when p=2; and n=10, k=3, when p=3. The method of degrouping A to obtain x, y and z comprises carrying out the following steps in an processor:

I) feeding p to said processor, and deciding values of n and k;

II) feeding A to said processor;

III) setting i=1;

IV) obtaining $q'=q_1-q_2+q_3 \ldots +(-1)^{k+1}\cdot q_k$, and $r'=r_1-r_2+r_3 \ldots +(-1)^{k+2}\cdot r_{k+1}$, wherein $q_j=(a_{n-1}, a_{n-2}, a_{n-3}, \ldots, a_{jp+1}, a_{jp})$;

$r_j=(a_{jp-1}, a_{jp-2}, a_{jp-3}, \ldots, a_{(j-1)p})$;

$r_{k+1}=(a_{kp})$ wherein j is an integer of 1 to k; and $(a_{n-1}, a_{n-2}, a_{n-3}, \ldots, a_1, a_0)$ is 2-tuple representation of A;

V) letting

A=q' and r=r', when $2^p+1>r'\geqq 0$;

A=q'−1 and r=r'+$(2^p+1)$, when 0>r'; and

A=q'+1 and r=r'−$(2^p+1)$, when $2^p+1\geqq r'$

VI) outputting x=r, when i=1; y=r, when i=2; and z=r, when i=3;

VII) setting i=i+1; and

VIII) returning to step I), when i=4; and returning to step IV), when i<4.

Architecture Design

It can be seen from FIG. 3 that four operands are generated by shifting in mode 2 and mode 3. These operands take the interlace computations of two subtractions and one addition. Although five operands are generated and need one extra addition in mode 1, the addition for the last operand of A>>4, a one digit number, can be viewed as an additional carry for the adder. This approach takes the advantage of reducing one addition in mode 1. More specifically, it has been compatible for the computation and architecture design in all three modes.

Figure 5:
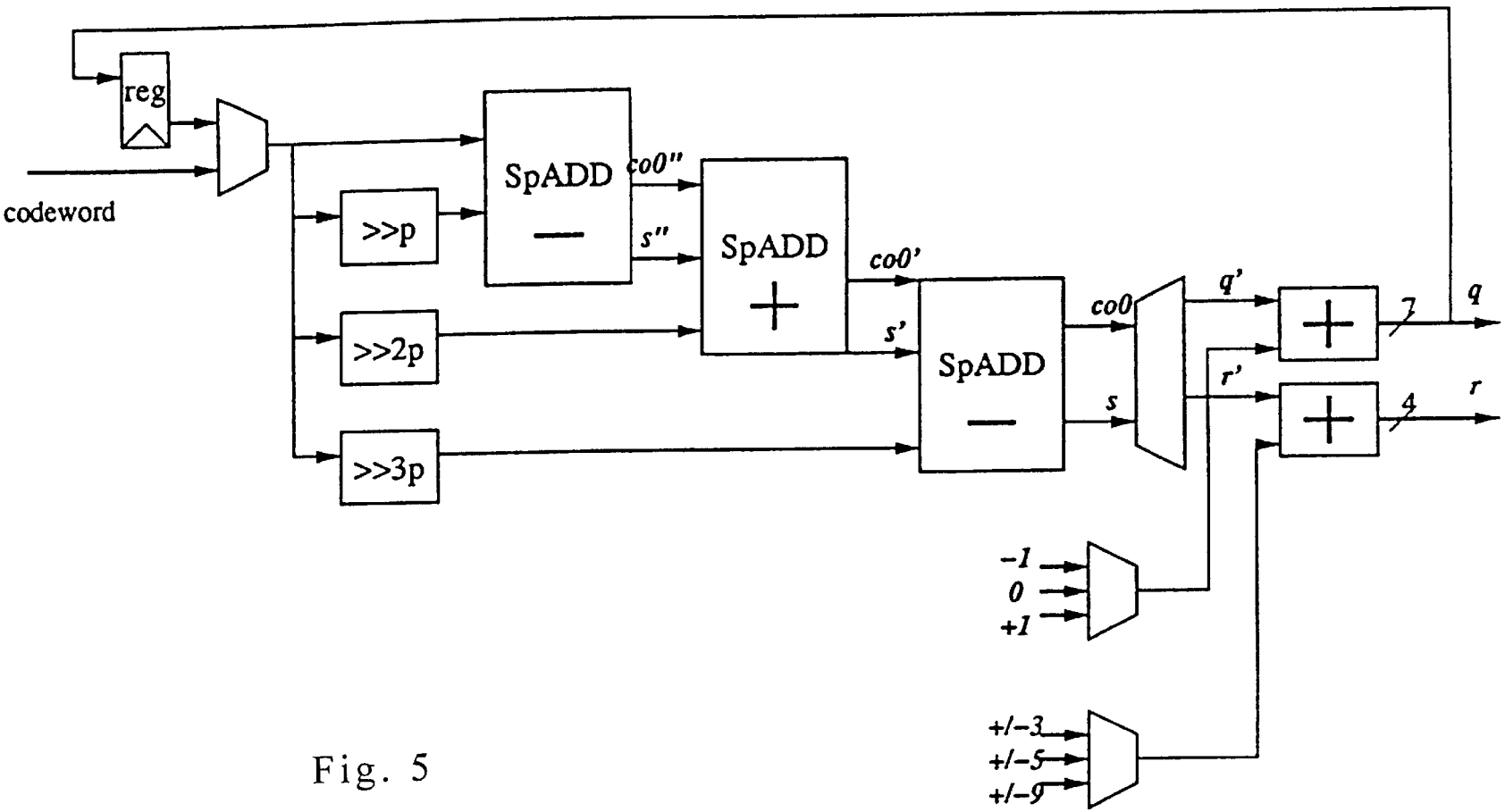
FIG. 5 is a block diagram showing a degrouping architecture suitable for carrying out the proposed algorithm according to the overall flow chart shown in FIG. 4.

A suitable architecture design is shown in FIG. 5, wherein 10-bit width is given to the codeword A to accommodate mode 3, and the codeword A is shifted right p, 2p and 3p bits by three shifters >>p, >>2p and >>3p respectively to generate three operands A>>p, A>>2p, and A>>3p. The codeword A and $A_{>>p}$ are fed to a first subtractor SpADD− to yield a first difference $S''=A-A_{>>p}$, the first difference S" and $A_{>>2p}$ are fed to a first adder SpADD+ to yield a first sum $S'=(A-A_{>>p})+A_{>>p}$, and the first sum S' and $A_{>>3p}$ are then fed to a second subtractor SpADD− to render a total sum S, wherein $S=A-A_{>>p}+A_{>>2p}-A_{>>3p}$. A first carry co0" of subtraction for the lowest p bits of S" (p-bit LSB) is also fed the first adder SpADD+ to yield a second carry co0' which is a sum of co0" and a carry of addition for the p-bit LSB of S', and then the second carry co0' is fed to the second subtractor SpADD− to yield a final carry co0 which is the sum of co0' and a carry of subtraction for the p-bit LSB of S. The final carry co0 and S are demultiplexed by a de-multiplexer into a quotient q' and remainder r'. A regular correction have to be performed to get the exactly right value of q and r from q' and r' respectively, wherein q=q' and r=r', when $2^p+1>r'\geqq 0$; q=q'−1 and r=r'+$(2^p+1)$, when 0>r'; and q=q'+1 and r=r'−$(2^p+1)$, when $2^p+1\geqq r'$. Prior to the correction, $a_4$ is added to r' if p=1, wherein $a_4$ is obtained by shifting the codeword A four bits right. Then r is output as a degrouped sample. The corrected quotient q is feedback and latched in the input register (reg) for use in the next degrouping cycle. This approach makes the design with the fixed throughput of one clock number per sample.

Figure 6:
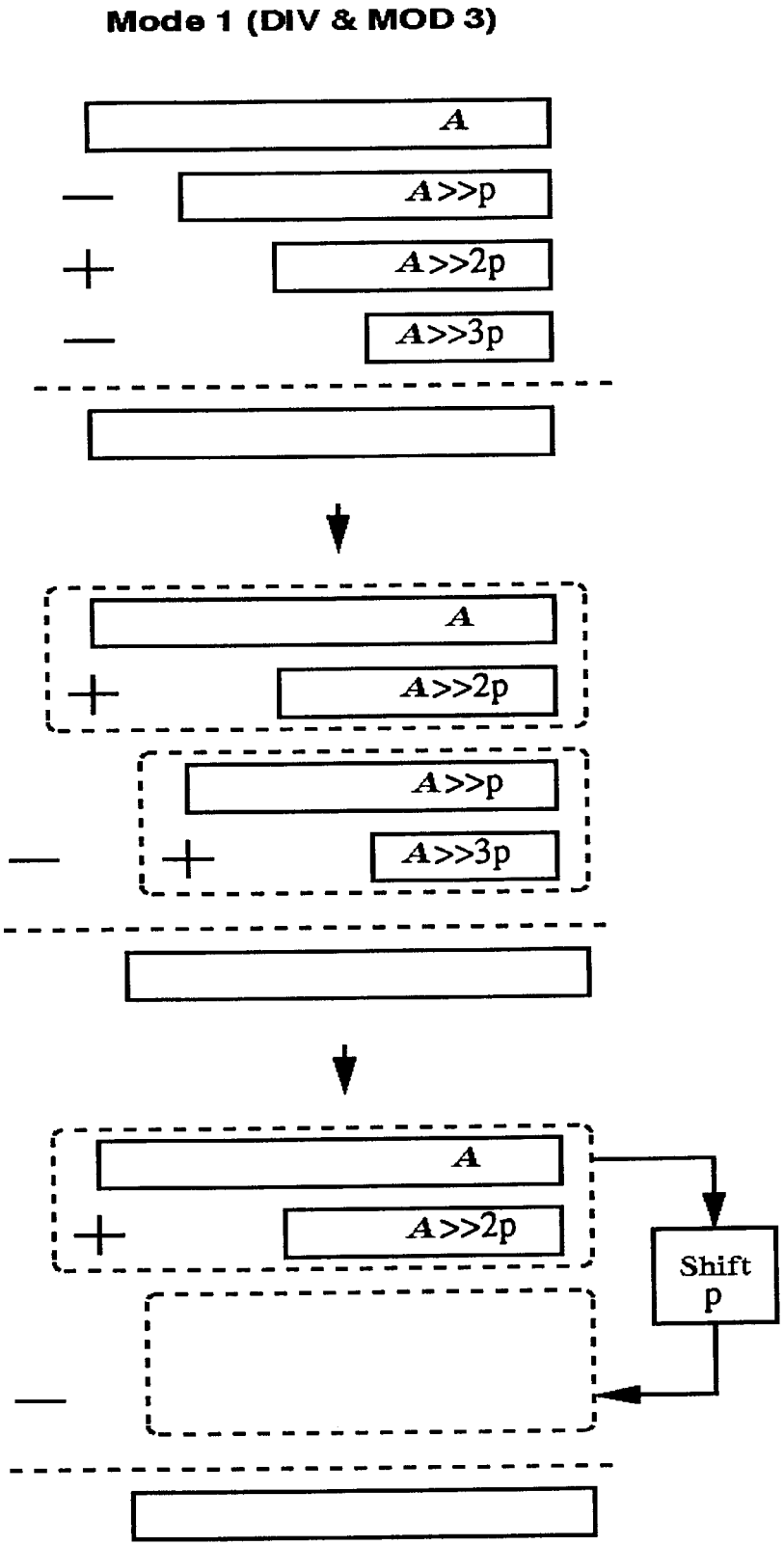
FIG. 6 is a graphical representation of a data reordering scheme for the fast calculations of q' and r' in all three modes.

Based on the previous discussions, the proposed algorithm can be implemented by two subtractions and one addition for four operands A, $A_{>>p}$, $A_{>>2p}$, and $A_{>>3p}$, in all three modes p=1, 2 and 3. In order to reduce the hardware cost, we use the concept of data reordering to change the computation data flow. We compute the operands of A and $A_{>>2p}$ and the associated arithmetic operation first, then compute the operands of $A_{>>p}$ and $A_{>>3p}$ and associated arithmetic operation. In fact the result for $A_{>>p}$ plus $A_{>>3p}$ is equal to the result for A plus $A_{>>2p}$ by only shifting right p bits. This means the arithmetic operation for $A_{>>p}$ plus $A_{>>3p}$ is trivial and can be removed. The data reordering scheme can reduce the arithmetic operations in saving of one subtractor chip area and be described in FIG. 6.

Figure 7:
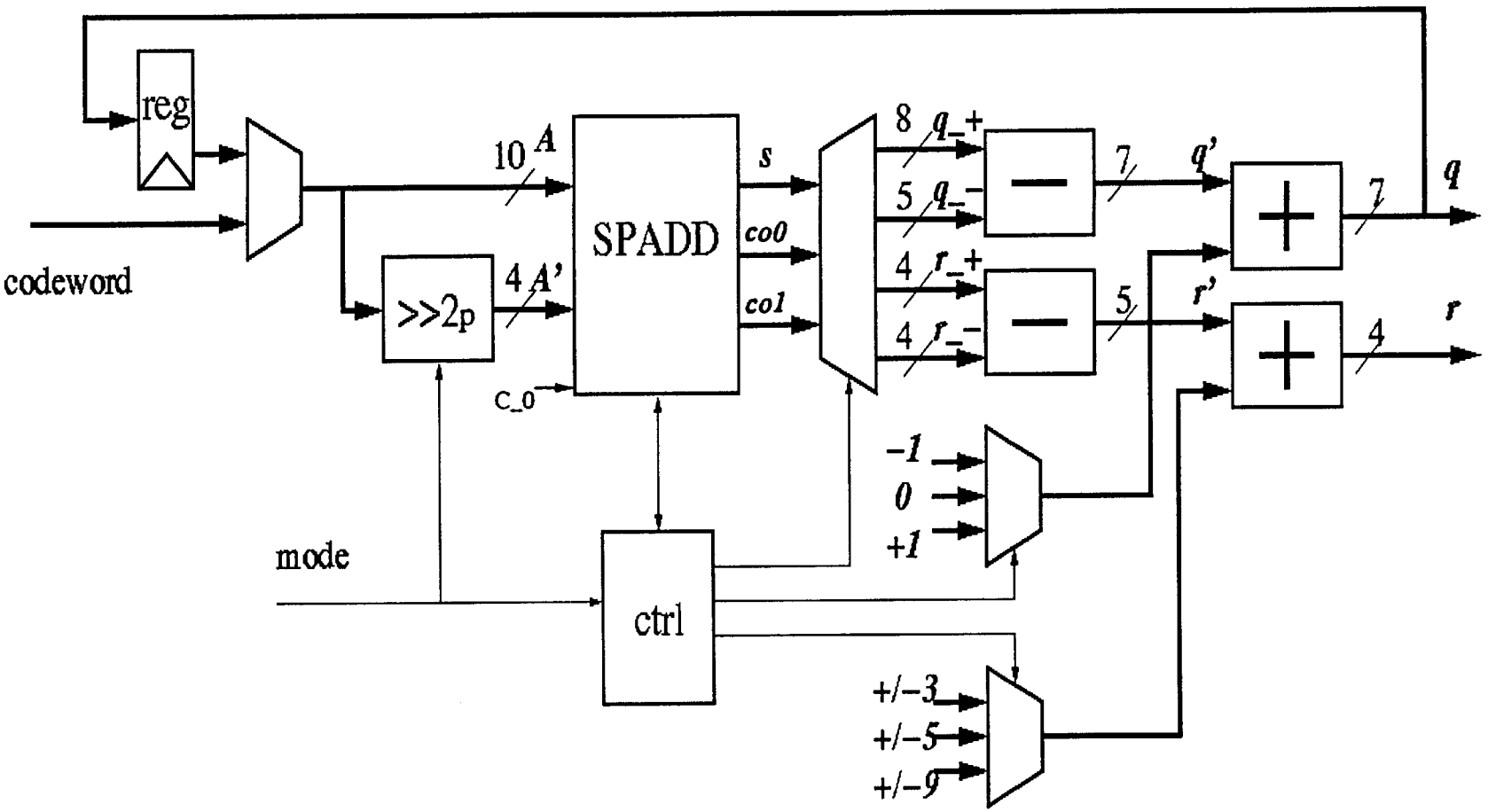
FIG. 7 is a block diagram showing a degrouping architecture suitable for carrying out the data reordering scheme shown in FIG. 6.

For the architecture design, the proposed algorithm with data reordering scheme is adopted. FIG. 7 shows the key components of this design include one special adder (SPADD), two subtractors (−) and two adders (+). Based on the maximum number ranges of codeword A in mode 3, 10-bit width bus is assigned for A. The shifter >>2p takes the right shift of 2p bits to obtain another operand A' from A. The SPADD generates a 10-bit sum of S, and three one-bit carries of co0, co1 and co2 . The co0 is the carry of addition for p-bit LSB, co2 is the carry of addition for 2p-bit LSB and the co1 is the carry for all-bit addition. The signals of S, co0, and co1 can be demultiplexed into the partial quotients of q_+ and q_−, and partial remainders r_+ and r_−. These partial quotients and partial remainders are fed into the two subtractors (−) to generate the quotient q' and the remainder r'. The following two adders (+) take the roles of correcting the quotient q' and the remainder r' into the real quotient q and the real remainder r. Finally, the real quotient q is treated as an operand for the next degrouping cycle and is feedback and latched in the input register. This approach makes the design with the fixed throughput of one clock number per sample. The detailed correcting steps for generating the real quotient q and the real remainder r from the quotient q' and the remainder r' are listed as follows:

I)

r=r', when $2^p+1>r'\geqq 0$;

r=r'+$(2^p+1)$, when 0>r';

r=r'−$(2^p+1)$, when $2^p+1\geqq r'$; and

II)

q=q'+1, when comprst or co2 is 1, and co0 is 0, otherwise q=q'−1, when co0 is 1 and co2 is 0, otherwise q=q', wherein comprst is 1, if $r' \geqq 2^p+1$ and co0 is 0, otherwise comprst is 0. Prior to step I), $a_4$ is added to r' if p=1, wherein $a_4$ is obtained by shifting the codeword A four bits right.

Figure 8:
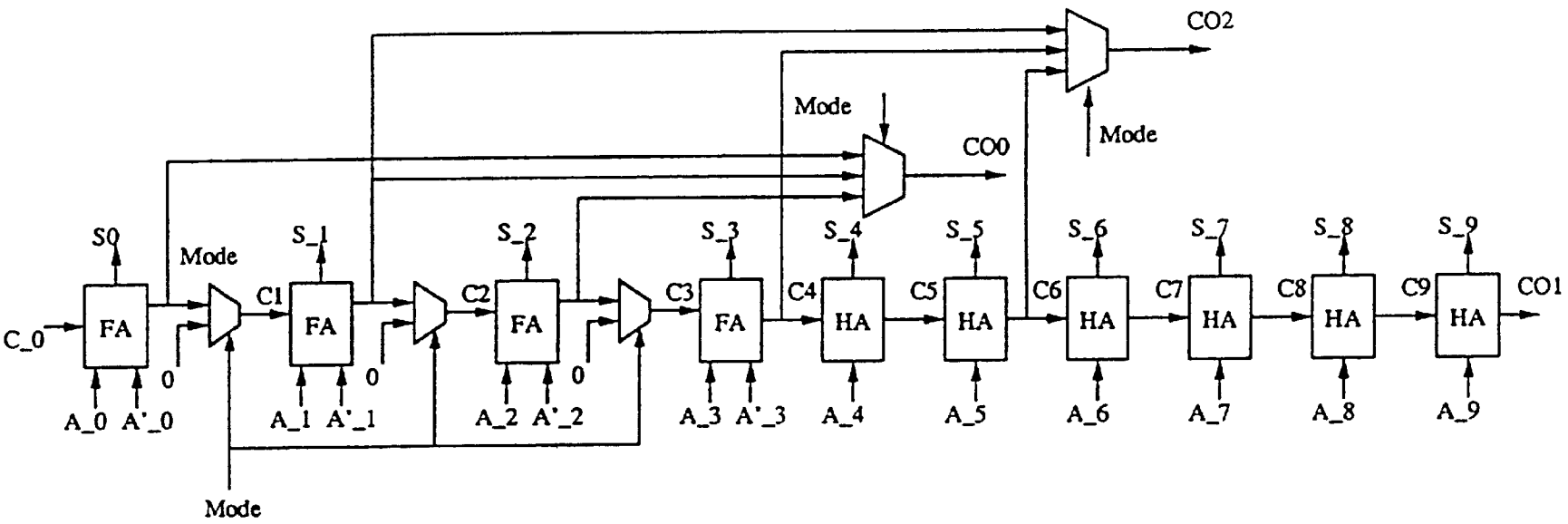
FIG. 8 is a block diagram showing the internal architecture of SPADD in FIG. 7.

The internal architecture of the SPADD in FIG. 7 is illustrated in FIG. 8. It basically consists of four full adders (FA) at the 4-bit LSB and six half adders (HA) at the 6-bit MSB with a ripple-carry architecture. The four full adders carry out the addition of A, A' and c_0 which is the carry represented as the additional operand in mode 1. The carries of addition from the first three full adders are fed to a logic unit so that the carry co0 of addition for p-bit LSB can be generated therefrom with the help of p (value representing the mode). The carries of addition from the second full adder, the fourth full adder and the second half adder are fed to another logic unit so that the carry co2 of addition for 2p-bit LSB can be generated therefrom with the help of p (value representing the mode). Each of the six half adders adds A and the carry from its preceding stage so that the carry col for all-bit addition from the last half adder.

A degrouping method for use in conjunction with the algorithm and architecture shown in FIGS. 7 and 8 comprises carrying out the following steps in an processor:

I) feeding p to said processor, and deciding values of n and k;

II) inputting the codeword A to said processor;

III) setting i=1;

IV) calculating a sum $S=A+A_{>>2p}$, wherein $A_{>>2p}$ is obtained by taking a right shift of 2p bits of 2-tuple representation of A, $(a_{n-1}, a_{n-2}, a_{n-3}, \ldots, a_1, a_0)$, or calculating a sum $S=A+A_{>>2p}+a_4$, when p=1;

V) obtaining $r_^+$, $q_^+$, co0, co1 , and co2 , wherein $r_^+$ is the value of the lowest p bits of S, $q_^+$ is the value of the upper (n−p) bits of S, co0 is the carry of addition for the lowest p bits of S, co2 is the carry of addition for the lowest 2p bits of S, and co1 I is the carry for all-bit addition of S;

VI) obtaining an operand $S_{>p}$ having (n−p) bits by taking a right shift of p bits of S, and obtaining $r_^-$, $q_^-$, wherein $r_^-$ is the value of the lowest p bits of $S_{>p}$, $q_^-$ is the value of the upper (n−2p) bits of $S_{>p}$;

VII) calculating $q'=q_^+-q_^-$, $r'=r_^+-r_^-$,

VIII)

$r=r'$, when $2^p+1>r' \geqq 0$;

$r=r'+(2^p+1)$, when $0>r'$;

$r=r'-(2^p+1)$, when $2^p+1 \geqq r'$;

IX)

A=q'+1, when comprst or co2 is 1, and co0 is 0, otherwise

A=q'−1, when co0 is 1 and co2 is 0, otherwise

A=q', wherein comprst is 1, if $r' \geqq 2^p+1$ and co0 is 0, otherwise comprst is 0;

X) outputting x=r, when i=1; y=r, when i=2; and z=r, when i=3;

XI) setting i=i+1; and

XII) returning to step I), when i=4; and returning to step IV), when i<4.

EXPERIMENTAL RESULTS

Figure 9A:
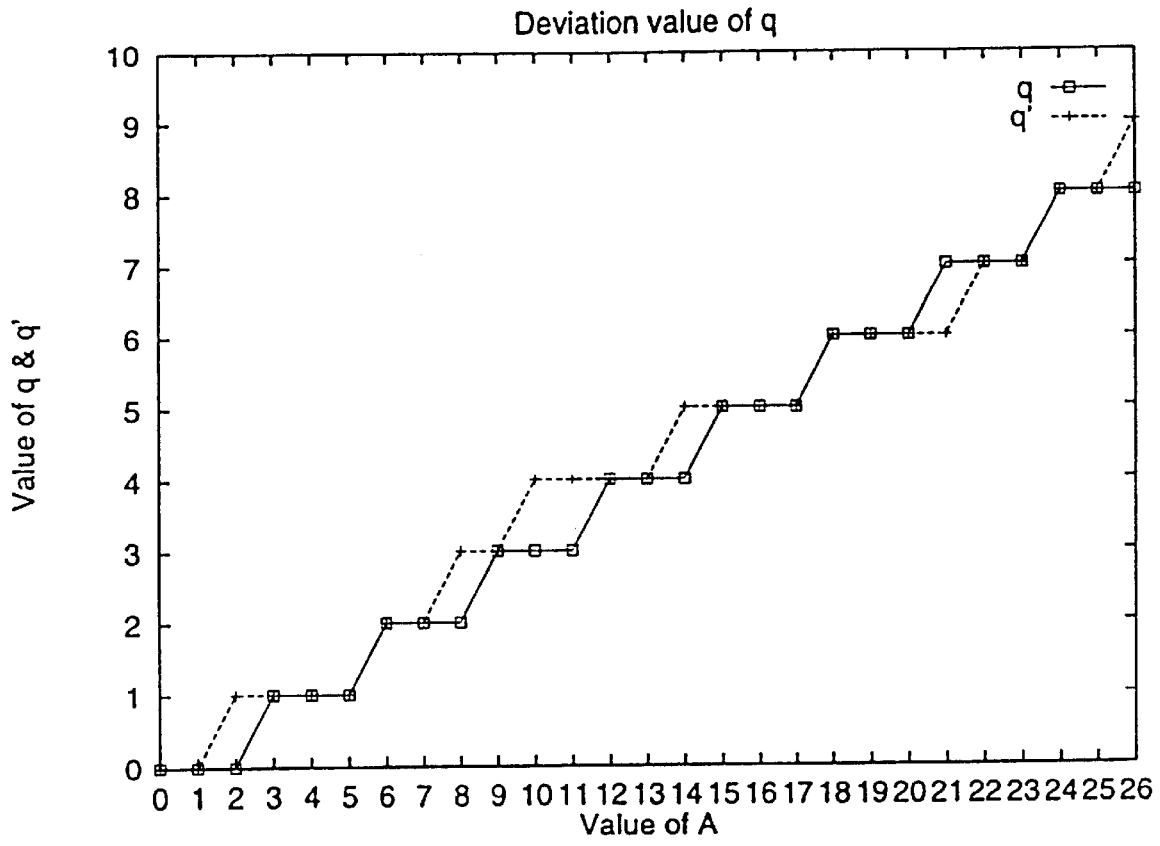
FIGS. 9*a* and 9*b* are plots showing experimental results of mode 1 for the deviation values of: a) q' with respect to q, and b) r' with respect to r.
Figure 9B:
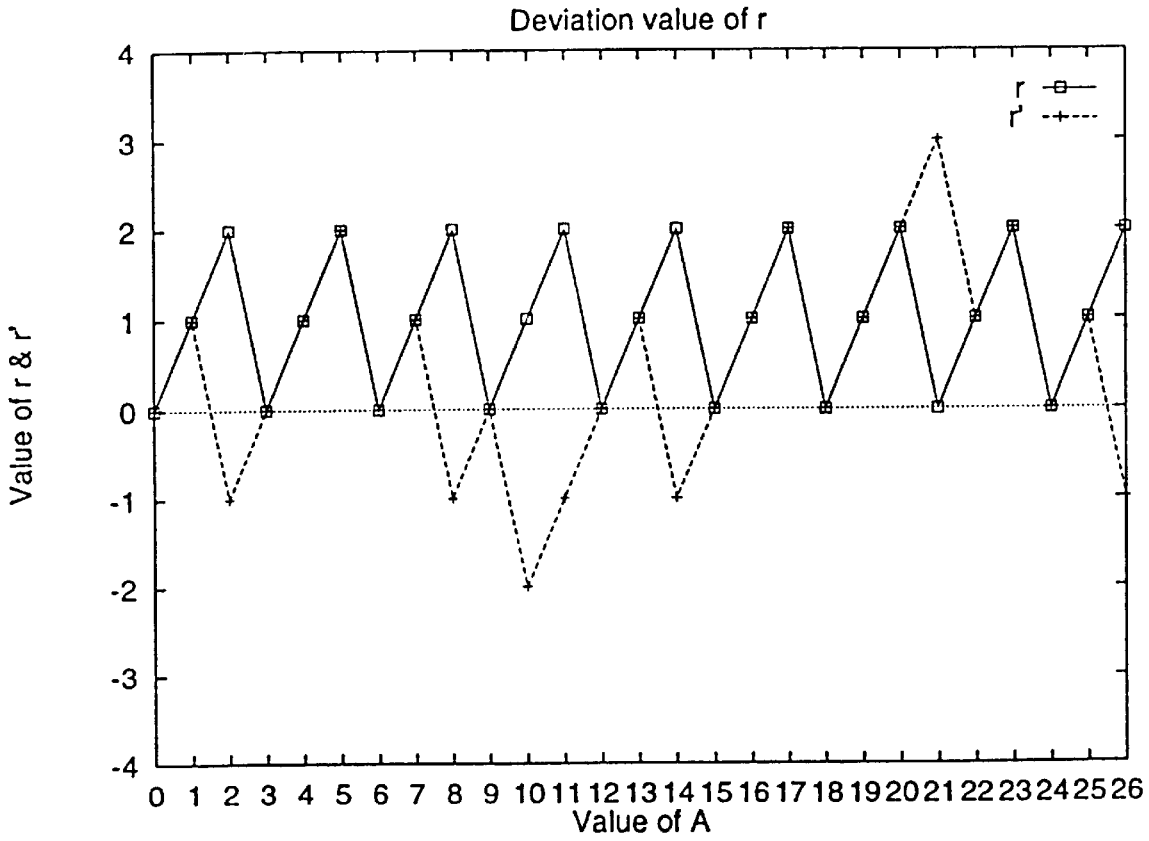

In this section, we describe the experimental results performed by the algorithms proposed in the present invention. For the sake of brevity, we only present experimental data for mode 1 as shown in FIGS. 9*a* and 9*b*. It graphically shows the deviation of q' with respect to q, and r' with respect to r. Most of the values q' and r' are equal to q and r, respectively. Specifically, it shows each point with the value of r which is greater than 2 has the value of q' which is less than q. The point with the value r which is less than 0 has the value of q' which is greater than q. All the differences between the q' and q are equal to one, zero or minus one.

Besides, the proposed degrouping architecture is implemented as a processor with some related technical details summarized in Table 3. In addition to regularity and modularity, this architecture have significant advantages in term of small area and high speed based on the applied technology.

TABLE 3

Statistical result of implemented degrouping processor

| | |
|---|---|
| Technology | 0.6$\mu$ CMOS SPDM |
| Gate count | 576 |
| Area | 510 × 454 $\mu^2$m |
| Measured propagation delay | 21.05 ns |

What is claimed is:

1. A method of degrouping a codeword having n bits and being grouped by:

$$A=(2^p+1)^2z+(2^p+1)y+x$$

wherein A is the codeword; x, y and z are three consecutive samples to be obtained; and p is 1, 2 or 3, said method comprising the following steps:

I) deciding values of n and k in an processor upon receipt of said p, wherein n=5 and k=4, when p=1; n=7, k=3, when p=2; and n=10, k=3, when p=3;

II) feeding A to said processor;

III) setting i=1;

IV) obtaining $q'=q_1-q_2+q_3 \ldots +(-1)^{k+1}\cdot q_k$, and $r'=r_1-r_2+r_3 \ldots +(-1)^{k+2}\cdot r_{k+1}$, wherein $q_j=(a_{n-1}, a_{n-2}, a_{n-3}, \ldots, a_{jp+1}, a_{jp})$;

$r_j=(a_{jp-1}, a_{jp-2}, a_{jp-3}, \ldots, a_{(j-1)p})$;

$r_{k+1}=(a_{kp})$ wherein j is an integer of 1 to k; and $(a_{n-1}, a_{n-2}, a_{n-3}, \ldots, a_1, a_0)$ is 2-tuple representation of A;

V) letting $A=q'$ and $r=r'$, when $2^p+1>r' \geqq 0$;

$A=q'-1$ and $r=r'+(2^p+1)$, when $0>r'$; and $A=q'+1$ and $r=r'-(2^p+1)$, when $2^p+1 \geqq r'$ VI) outputting x=r, when i=1; y=r, when i=2; and z=r, when i=3;

VII) setting i=i+1; and

VIII) returning to step I), when i=4; and returning to step IV), when i<4.

2. The method according to claim 1, wherein p=1, $A=(a_4, a_3, a_2, a_1, a_0)$, $$q' = q_1 - q_2 + q_3 - q_4$$

$$= (a_4, a_3, a_2, a_1) - (a_4, a_3, a_2) + (a_4, a_3) - (a_4), \text{ and}$$

$$r' = r_1 - r_2 + r_3 - r_4 + r_5$$

$$= a_0 - a_1 + a_2 - a_3 + a_4.$$

3. The method according to claim 1, wherein p=2, A=($a_6$, $a_5$, $a_4$, $a_3$, $a_2$, $a_1$, $$q' = q_1 - q_2 + q_3$$

$$= (a_6, a_5, a_4, a_3, a_2) - (a_6, a_5, a_4) + (a_6), \text{ and}$$

$$r' = r_1 - r_2 + r_3 - r_4$$

$$= (a_1, a_0) - (a_3, a_2) + (a_5, a_4) - a_6.$$

4. The method according to claim 1, wherein p=3, A=($a_9$, $a_8$, $a_7$, $a_6$, $a_5$, $a_4$, $$q' = q_1 - q_2 + q_3$$

$$= (a_9, a_8, a_7, a_6, a_5, a_4, a_3) - (a_9, a_8, a_7, a_6) + (a_9), \text{ and}$$

$$r' = r_1 - r_2 + r_3 - r_4$$

$$= (a_2, a_1, a_0) - (a_5, a_4, a_3) + (a_8, a_7, a_6) - a_9.$$

5. The method according to claim 1, wherein p=1, and r' and q' are obtained by calculating S=A−($q_1$−$q_2$+$q_3$−$q_4$), and calculating r'=LSB+(1,0)·co0, and q'=MSB−(co0), wherein LSB is the value of the lowest one bit of S, MSB is the value of the upper four bits of S, and co0 is the one-bit carry of addition for the lowest one bit of S.

6. The method according to claim 1, wherein p=2, and r' and q' are obtained by calculating S=A−($q_1$−$q_2$+$q_3$), and calculating r'=LSB+(1,0,0)·co0, and q'=MSB−(co0), wherein LSB is the value of the lowest two bits of S, MSB is the value of the upper five bits of S, and co0 is the one-bit carry of addition for the lowest two bits of S.

7. The method according to claim 1, wherein p=3, and r' and q' are obtained by calculating S=A−($q_1$−$q_2$+$q_3$), and calculating r'=LSB+(1,0,0,0)·co0, and q'=MSB−(co0), wherein LSB is the value of the lowest three bits of S, MSB is the value of the upper seven bits of S, and co0 is the one-bit carry of addition for the lowest three bits of S.

8. A method of degrouping a codeword having n bits and being grouped by:

$$A=(2^p+1)^2z+(2^p+1)y+x$$

wherein A is the codeword; x, y and z are three consecutive samples to be obtained; and p is 1, 2 or 3, said method comprising the following steps:

I) deciding values of n and k in an processor upon receipt of said p, wherein n=5 and k=4, when p=1; n=7, k=3, when p=2; and n=10, k=3, when p=3;

II) feeding A to said processor;

III) setting i=1;

IV) calculating a sum S=A+$A_{>>2p}$, wherein $A_{>>2p}$ is obtained by taking a right shift of 2p bits of 2-tuple representation of A, ($a_{n-1}$, $a_{n-2}$, $a_{n-3}$, . . . , $a_1$, $a_0$), or calculating a sum S=A+$A_{>>2p}$+$a_4$, when p=1;

V) obtaining r_$^+$, q_$^+$, co0, co1 , and co2 , wherein r_$^+$ is the value of the lowest p bits of S, q_$^+$ is the value of the upper (n−p) bits of S, co0 is the carry of addition for the lowest p bits of S, co2 is the carry of addition for the lowest 2p bits of S, and co1 is the carry for all-bit addition of S;

VI) obtaining an operand $S_{>p}$ having (n−p) bits by taking a right shift of p bits of S, and obtaining r_$^-$, q_$^-$, wherein r_$^-$ is the value of the lowest p bits of $S_{>p}$, q_$^-$ is the value of the upper (n−2p) bits of $S_{>p}$;

VII) calculating
q'=q_$^+$−q_$^-$,
r'=r_$^+$−r_$^-$,

VIII)
r=r', when $2^p$+1>r'≧0;
r=r'+($2^p$+1), when 0>r';
r=r'−($2^p$+1), when $2^p$+1≧r';

IX)
A=q'+1, when comprst or co2 is 1, and co0 is 0, otherwise
A=q'−1, when co0 is 1 and co2 is 0, otherwise
A=q',
wherein comprst is 1, if r'≧$2^p$+1 and co0 is 0, otherwise comprst is 0;

X) outputting x=r, when i=1; y=r, when i=2; and z=r, when i=3;

XI) setting i=i+1; and

XII) returning to step I), when i=4; and returning to step IV), when i<4.

* * * * *